United States Patent [19]

Ronnback

[11] Patent Number: 4,818,214

[45] Date of Patent: Apr. 4, 1989

[54] DEVICE FOR EXTINGUISHING THE FLAME OF A CANDLE

[76] Inventor: Sture Ronnback, Box 172, S-430 93 Halso, Sweden

[21] Appl. No.: 187,527

[22] PCT Filed: Aug. 24, 1987

[86] PCT No.: PCT/SE87/00370

§ 371 Date: Jun. 6, 1988

§ 102(e) Date: Jun. 6, 1988

[87] PCT Pub. No.: WO88/01714

PCT Pub. Date: Mar. 10, 1988

[30] Foreign Application Priority Data

Aug. 25, 1986 [SE] Sweden ..... 8603568

[51] Int. Cl.[4] ..... F23N 5/00

[52] U.S. Cl. ..... 431/35; 431/289; 431/288

[58] Field of Search ..... 431/33, 35, 288, 289

[56] References Cited

U.S. PATENT DOCUMENTS 4,138,211 2/1979 Kampfer et al. ..... 431/35

FOREIGN PATENT DOCUMENTS 1423888 11/1965 France ..... 431/35

*Primary Examiner*—Randall L. Green

*Attorney, Agent, or Firm*—Harness, Dickey & Pierce

[57] ABSTRACT

A burning candle (5, 8) is provided with a sleeve (7, 7') of heat-shrinkable plastics. When affected by the heat generated by the flame (6) of the lit candle the sleeve (7, 7') shrinks and at least partly closes about the end of the candle (5, 8), thus extinguishing the candle flame (6).

1 Claim, 1 Drawing Sheet

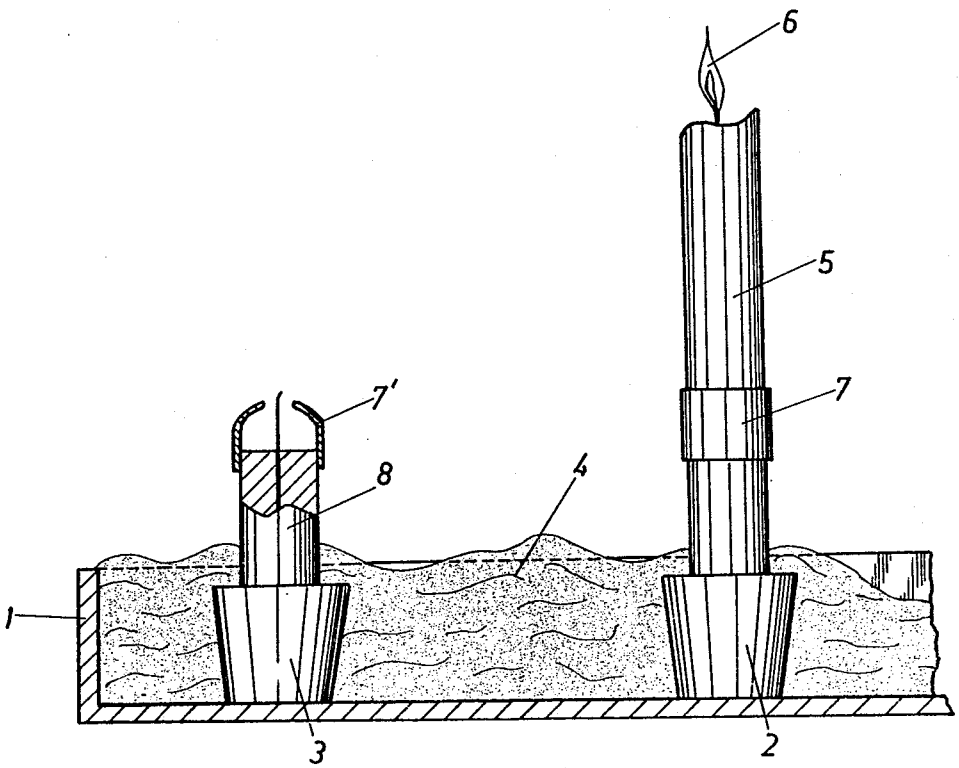
6
5
7
7'
8
4
2
3
1

DEVICE FOR EXTINGUISHING THE FLAME OF A CANDLE

The subject invention concerns a device for extinguishing the flame of a candle to prevent that the flame of the burning candle progresses so far along the length of the candle that there is a risk that the flame will cause fires.

Several devices for this purpose are known. A feature that these devices have in common is their unnecessarily complicated structure. This is due to the fact that they are based on the principle that as soon as the flame reaches a predetermined level one movable part of the structure is activated and either by pivoting about a joint or otherwise, moves in over the flame and extinguishes the latter by suffocation. The prior-art devices often make the candle unnecessarily expensive and in some cases they are not particularly reliable.

The subject invention provides a device which is very simple and inexpensive, yet it is capable of ensuring that the candle flame will be positively extinguished when it reaches a predetermined level along the length of the candle. The invention is characterized by a sleeve of heat-shrinkable plastics which is applied about the candle so as to encircle the latter, which sleeve, when affected by the heat generated by the candle flame, is arranged to shrink and thus at least partly close about the end of the candle, thus extinguishing the flame.

The invention will be described in closer detail in the following with reference to the accompanying drawing FIGURE, which is a fragmentary lateral view of a candle stick intended to hold a number of candles, two of which are shown in the drawing.

The candlestick 1 illustrated in the drawing comprises a number of candle holding members, two 2 and 3' of which are shown in the fragmentary view, of the drawing. For purposes of decoration, the candlestick is filled with e.g. dried moss 4 or other flammable materials.

Candle holding member 2 supports a burning candle 5. At the lower part of the candle 5, a considerable distance below the burning flame 6 and immediately above the moss 4, a sleeve 7 of heat-shrinkable plastics is applied around the candle. The plastics could be translucent so that it will be practically invisible, if desired, and contrary to the situation illustrated in the drawing FIGURE.

The candle holding member 3 supports an extinguished candle 8. This candle has burnt to the point where the heat from the burning flame has heated a plastic sleeve 7' corresponding to sleeve 7 on candle 5. The upper part of the sleeve 7' therefore has started to shrink and contract about the upper end of the candle 8. The supply of oxygen to the flame therefore is reduced and the flame size is diminishing. As a result, also the gasification of the material (stearine) of the candle 8 is reduced, leading to extinction of the flame.

The plastic sleeve 7, 7' may be displaced along the candle 5, 8 and it may be stopped at any desired level above the candle holding members 2, 3 according to wish. For instance, it may sometimes be desired to fill the entire candlestick with moss 4 which thus will reach up to a considerable level along the length of the candle 5, 8. Consequently, it becomes necessary to ensure that the candle is extinguished comparatively early, well before the flame approaches the moss. At other times, for instance when a candlestick holding four candles is used, one for each Sunday of Advent, one may wish to extinguish the candle lit on the first Sunday of Advent after just a brief period of burning to ensure that the candle could be lit also on the following three Sundays of Advent. In each case the desired burning time is easily established in advance by placing the device in accordance with the invention at the desired level along the candle, whereby extinction of the candle flame will be achieved automatically at the desired point. Thus there is no risk that a burning candle, left unattended, will burn until consumed or until the flame reaches the holding means and perhaps cause fires.

A candle 5, 8 which has been extinguished by the plastic sleeve 7, 7' after the preselected burning time can easily be relit by removing the plastic sleeve and replacing it by a fresh sleeve which is positioned at a lower level around the candle. If the plastic sleeve 7, 7' is sufficiently long it may quite simply be cut off to remove the heat-shrunk part thereof and the remainder of the sleeve be applied further down along the candle 5, 8 for re-use.

Instead of using a plastic sleeve 7, 7' which is hardly visible it may be possible to use a coloured and/or patterned sleeve for decorative purposes.

I claim:

1. A device for extinction of the flame of a burning candle, characterized by a sleeve of heat-shrinkable plastic which is applied about the candle so as to encircle the latter, which sleeve, when affected by the heat generated by the candle flame, is arranged to shrink and at least partly close about the end of the candle, thus extinguishing the flame.

* * * * *